US006227012B1

(12) United States Patent
Borroni et al.

(10) Patent No.: US 6,227,012 B1
(45) Date of Patent: May 8, 2001

(54) DEVICE FOR HOUSING DETERGENTS AND/OR OTHER WASHING AGENTS WHICH CAN BE USED IN A WASHING MACHINE, PREFERABLY IN A MACHINE FOR WASHING LAUNDRY

(75) Inventors: Giuseppe Borroni; Carlo Carli, both of Varese (IT)

(73) Assignee: T&P S.p.A., Varese (IT)

( * ) Notice: Subject to any disclaimer, the term of this patent is extended or adjusted under 35 U.S.C. 154(b) by 0 days.

(21) Appl. No.: 09/218,016

(22) Filed: Dec. 22, 1998

(30) Foreign Application Priority Data

Dec. 23, 1997 (IT) ..... MI97A2864

(51) Int. Cl.[7] ..... D06F 39/02

(52) U.S. Cl. ..... 68/17 R; 68/207; 134/93; 137/625.46

(58) Field of Search ..... 68/232, 133, 131, 68/134, 17 R, 207; 137/625.46; 222/636; 134/93

(56) References Cited

U.S. PATENT DOCUMENTS 3,567,076 * 3/1971 Zanussi .
3,760,612 * 9/1973 Bochan et al. .
3,949,576 * 4/1976 Waugh et al. .
4,043,158 * 8/1977 Bochan .
4,426,362 * 1/1984 Copeland et al. .
5,253,494 * 10/1993 Frucco et al. .
5,375,438 * 12/1994 Babuin .
5,579,656 12/1996 Shin .
5,588,313 * 12/1996 Hildebrand .
5,685,178 * 11/1997 Ahn .
5,687,590 * 11/1997 Borroni et al. .
5,884,506 * 3/1999 Blauert et al. .
6,044,510 * 4/2000 Cho .
6,101,851 * 8/2000 Bolduan et al. .

FOREIGN PATENT DOCUMENTS 1 585 660 6/1971 (DE) .
2724426 * 12/1978 (DE) .
2 632 984 12/1989 (FR) .
2639134 * 1/1991 (FR) .
2 165 555 4/1986 (GB) .

OTHER PUBLICATIONS

European Patent Application 125, 627, Nov. 1984.*

* cited by examiner

*Primary Examiner*—Frankie L. Stinson
(74) *Attorney, Agent, or Firm*—Young & Thompson

(57) ABSTRACT

Device for housing washing agents which can be used in a washing machine, preferably in a machine for washing laundry, comprising a body of the device having one or more vessels for housing washing agents and one or more conduits for conveying respective flows of water to each of said vessels for housing the washing agents to remove the agent contained therein and the subsequent feeding of the same to the washing tub of the machine. The body of the device comprises at least one portion defining directly at least part of said conveying conduits or a portion for access to said conduits. Said portion being attached in a removable or openable manner to the remaining part of the body of the device.

12 Claims, 10 Drawing Sheets

DEVICE FOR HOUSING DETERGENTS AND/OR OTHER WASHING AGENTS WHICH CAN BE USED IN A WASHING MACHINE, PREFERABLY IN A MACHINE FOR WASHING LAUNDRY

FIELD OF THE INVENTION

The present invention relates to a device for housing washing agents which can be used in a washing machine, preferably in a machine for washing laundry.

BACKGROUND OF THE INVENTION

The devices of the aforementioned kind of the known type, called inappropriately "drawers" in the field, usually comprise a body of the device housing one or more vessels, each containing a quantity of a respective washing agent, such as a detergent, bleach, fabric conditioner or another type, and means for conveying respective flows of water to each of said washing agents housing vessels to remove the agent contained therein and for transporting it to the tub of the machine, where the operation of washing the articles of laundry takes place.

In the "drawers" of the known type said means for conveying the flows of water to the vessels to remove the respective washing agent comprise conveying conduits for respective flows of water, which conduits end with holes formed in a wall of the body of the device situated at said vessels, from which the respective flow of water is poured into corresponding vessels for removing the washing agent contained in the latter.

The use of this kind of device of the known type is disadvantageous from various viewpoints. There is first of all a problem linked to the presence of ions or encrusting agents in the flows of water for removing the washing agents passing through said conduits and holes of the device or "drawer" housing the washing agents. Said flows of water for removal, after a certain period of time of use of the washing machine, therefore have the tendency to leave encrusting deposits which clog the conduits and, more particularly, the holes for transfer of the flow of water to the respective washing agents housing vessels.

This fact, which obviously is felt more greatly in areas wherein the water available has a particularly high degree of hardness, entails, after a certain number of cycles of use of the washing machine, the impossibility of providing any flow of water or a correct flow of water for removing a suitable quantity of detergent. This leads to incomplete washing operations and even those which are damaging to the garments being washed.

In order to avoid these disadvantages, current practice consists in replacing the clogged detergents housing drawer with a new drawer, which operation may only be concluded by specialist staff specially contacted by the domestic user of the washing machine.

This operation is therefore, as well as irritating in that it involves stopping the machine until the specialist technician has answered the call affirmatively, excessively expensive, in that it entails a certain cost inherent in the total cost of the drawer to be replaced and the cost of the work force used during this operation of replacement.

SUMMARY OF THE INVENTION

At least some of the problems referred above, to be found in the washing agents housing devices used in washing machines known hitherto, are solved by a washing agents housing device having the features disclosed herein.

More particularly the provision of an attachment of the removable or openable type between the body of the device and a portion of the same body of the device, which forms directly or houses said conduits for conveying flows and if necessary said transfer holes, provides access to said conduits and relative holes and therefore allows the performance of an operation of cleaning of encrustation or if necessary replacement of said removable portion.

A saving of costs is achieved in that it is no longer necessary to replace the entire washing agents housing device or "drawer".

Since it is not necessary to replace the entire drawer, whose removal from the washing machine entailed performance of operations of detaching of pipes and relevant clips and disconnection of valve assemblies, the aforementioned operations of cleaning of the "drawer" may be performed directly by the user of the washing machine, without it being necessary to rely on specialist assistance personnel, with the further advantages relating to a greater promptness of intervention—it is no longer necessary to wait for the arrival of the specialist staff—and saving in the costs of labour. The secondary claims relate to preferred embodiments of the present invention.

BRIEF DESCRIPTION OF DRAWINGS

Further features and advantages will in any case be made clearer on reading of the following description, relating to preferred embodiments of the invention, to be read with reference to the accompanying drawings, in which.

DESCRIPTION OF PREFERRED EMBODIMENTS

Figure 1:
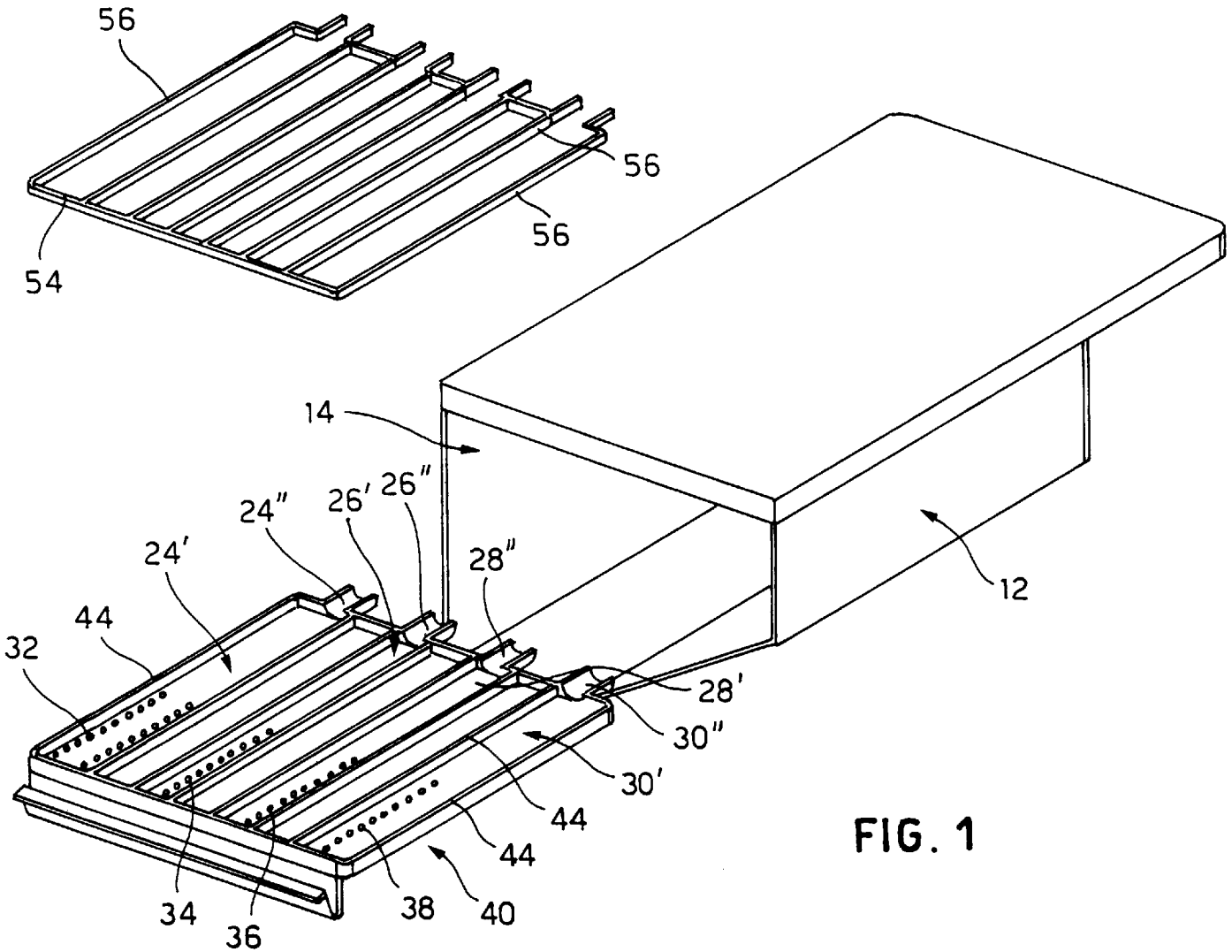
FIG. 1 is a perspective view relating to the washing agents housing device, to the removable part thereof and to the hermetic sealing means according to a first preferred embodiment of the present invention.

FIGS. 1 to 4 show a first preferred embodiment of the device for housing washing agents of the present invention.

The device essentially comprises a body of the device which has a main part 12 intended to be attached firmly to the frame of the washing machine and having a cavity 14 open at a front end for insertion of a mobile drawer 16 forming vessels 18, 20 and 22 for housing washing agents, such as detergent for a prewash 18', a detergent 20' for actual washing, and for bleach or fabric conditioner 22'.

Conduits are also provided, denoted overall by 24, 26, 28, 30 respectively, for conveying respective flows of water to said vessels for removing the agent contained therein and transporting it to the washing tub of the machine.

As shown clearly in FIG. 2B, the removal water flows passing through said conduits are made to fall through respective holes 32, 34, 36, 38 onto the detergent contained respectively in the vessel below, as exemplified by the arrows F.

According to the first preferred embodiment shown here, the parts of said conveying conduits which are located above said detergent agents housing vessels and which are denoted by reference numerals 24', 26', 28'and 30' and the relative holes are provided on a portion 40 defining above said cavity 14 for insertion of the drawer, which is attached removably to the remaining part of the body of the device.

In the embodiment shown said conveying conduits and relative holes of the removable portion send the water flows for removal only onto the vessels of detergents 18 and 20. Obviously portions of a different configuration capable of sending water onto all the vessels could also be devised.

The removable portion 40 for transfer of the removal flows has, according to the first preferred embodiment shown here, a substantially flat base panel 42 and a series of short walls 44 extending upwards and defining said conduits 24', 26', 28', 30' for conveying flows of water towards the washing agents housing vessels.

Figure 4:
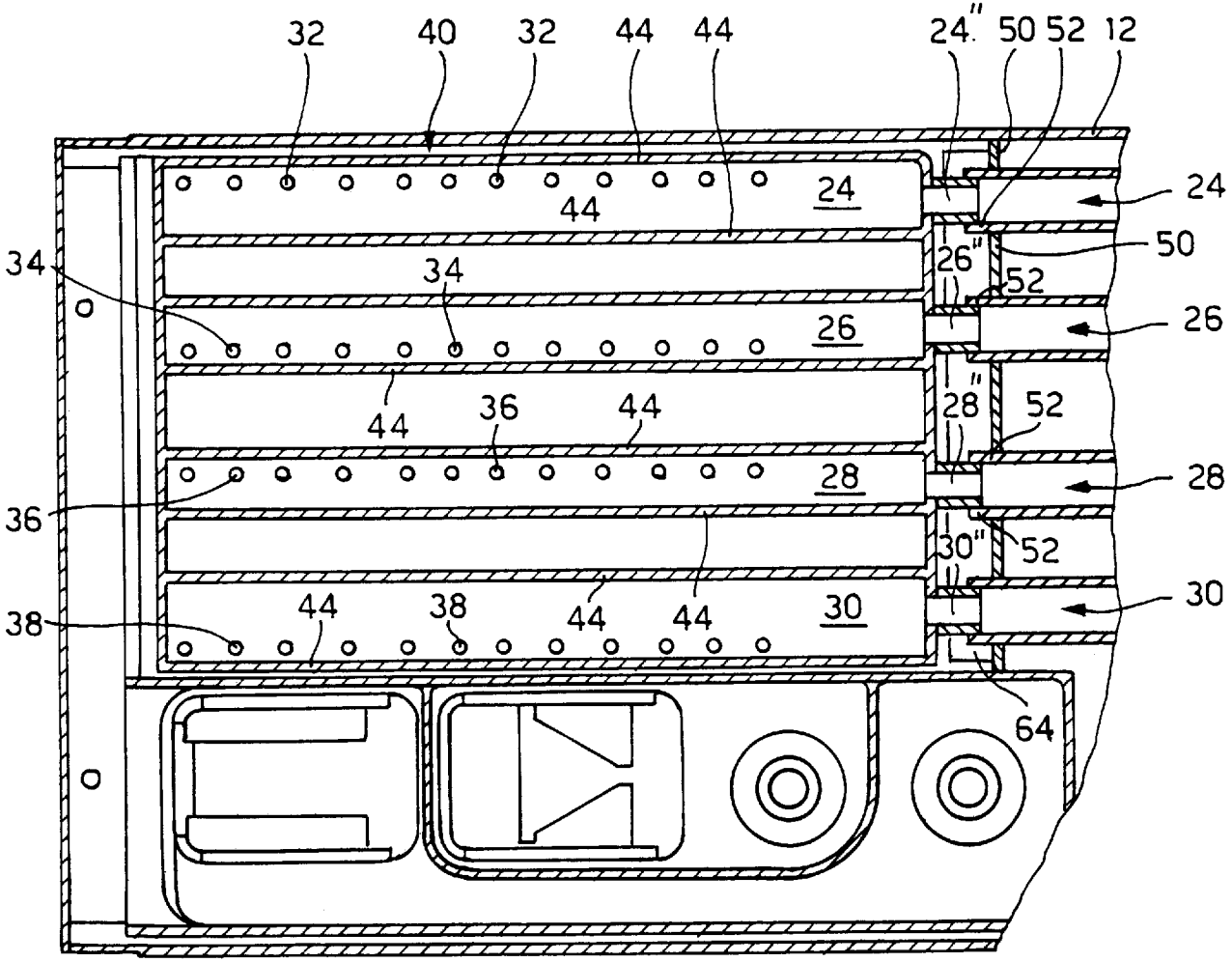
FIG. 4 is a sectioned view taken along line 4—4 of FIG. 2B relating to the first preferred embodiment of the present invention.

As shown in FIG. 4, the aforementioned removable portion 40, provided with holes for the transfer of the flows, is located in an appropriate housing seat for said removable portion situated in a position above said cavity 14 for the mobile drawer. Said seat of housing for the removable perforated portion 40 has at least one upper wall 46 comprising a series of short opposite walls 48 for support for said portion and an end vertical wall 50 wherein nozzles 52 are provided for coupling with corresponding nozzles 24", 26", 28", 30" of the removable portion for sending into the conduits 24', 26', 28', 30', of the removable portion 40 the relative flows of water.

Between said removable portion 40 and the housing in the body of the device suitable for receiving and matching the profile of the same removable portion 40, a shaped gasket 54 is provided which has a series of linear elements 56 which match exactly to create a seal between the opposite short walls 44 and 48 and prevent any undesirable leakage of water towards other conduits.

The means for removable attachment provided between said perforated portion 40 for transfer of the flows to the washing agents housing vessels and the remaining part of the device comprise suitable means for release engaging of the removable part with the body of the device.

Said release engaging means comprise a small hooking tooth 58 for an opposite and corresponding horizontal protuberance 60 of the body of the device. The small hooking tooth 58 is supported at the end of a tab 62 having a U profile which allows elastic yielding in a horizontal direction for the purpose of engaging and disengaging when necessary said small tooth 58 with the corresponding attachment protuberance 60.

Said release hooking means 58, 62 are provided on the side opposite the one occupied by said nozzles 24", 26", 28", 30" for coupling between the removable portion and the vertical wall 50 of the main body of the device.

The means of attachment of the removable portion 40 to the body of the device also comprise a flexible fin 64 suitable for restraining elastically said removable portion towards and against the upper wall, more particularly against the short walls 48 extending from the latter downwards, of the seat for housing the removable portion. Said flexible fin 64 extends substantially horizontally and is situated below said coupling nozzles 52 in such a way as to engage the underlying part of said removable portion 40.

Said attachment means also comprise a second flexible fin 66 suitable for restraining elastically the nozzles 24", 26", 28", 30" of said removable portion 40 towards and against the nozzles 52 projecting from the end vertical wall 50 of the body of the device.

Said flexible fin 66 extends substantially vertically in such a position as to engage the side wall of the end of said removable portion 40 which is opposite that occupied by said coupling nozzles.

Figure 3A:
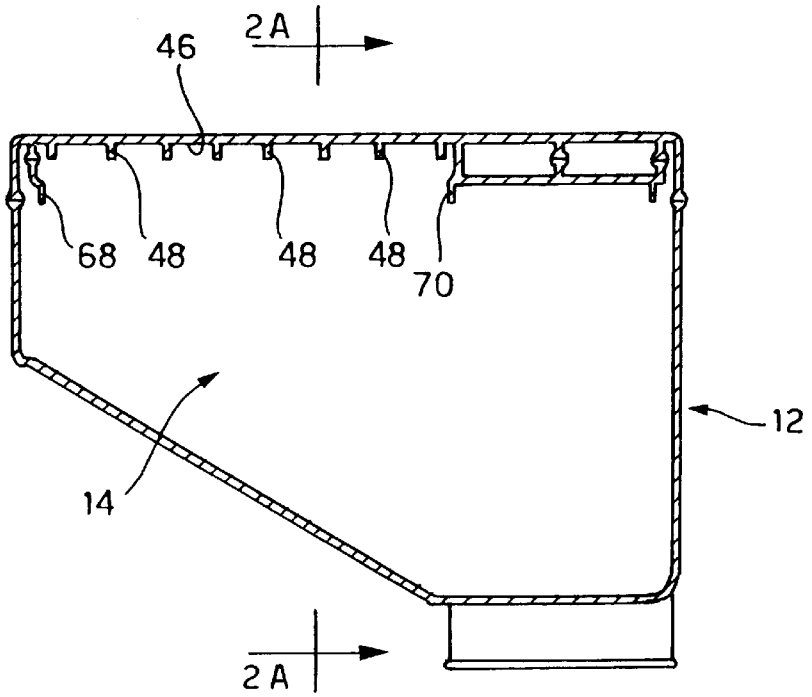
FIGS. 3A and 3B are sectioned views taken along lines 3A—3A and 3B—3B of FIGS. 2A and 2B respectively of the first preferred embodiment of the present invention.
Figure 3B:
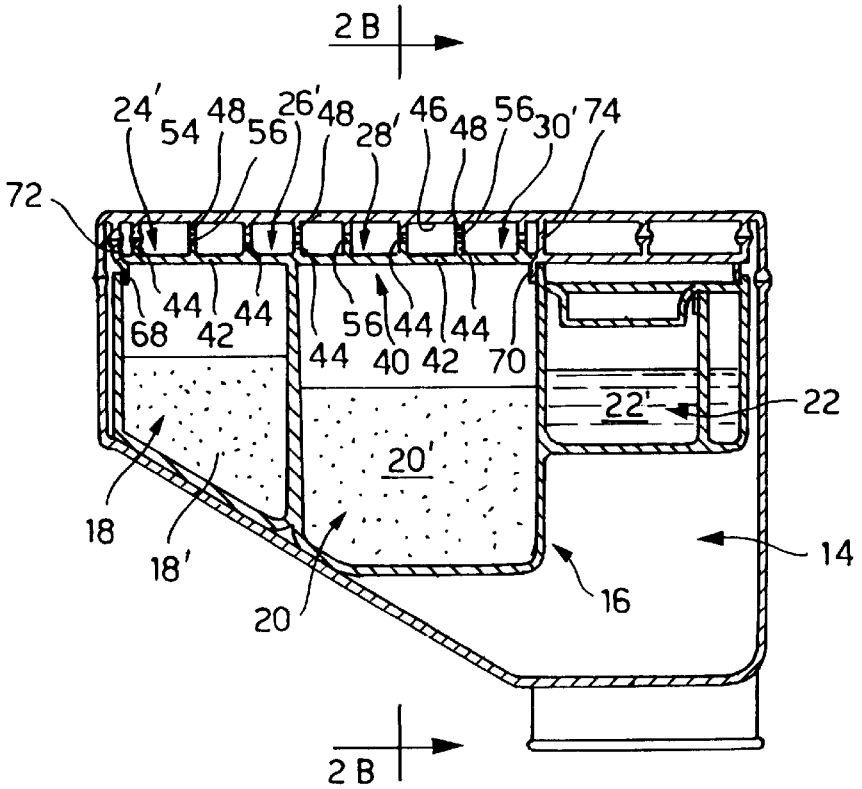

The attachment means also comprise a first and a second lateral flexible fin 68 and 70 acting, as shown in FIG. 3B, on the lateral longitudinal edges 72 and 74 of the removable portion to clamp it between them and push it upwards towards the short walls 48 extending from the upper wall of the housing for the removable portion. Said first and second lateral fins 68 and 70 extend downwards substantially vertically and have a curved engaging portion for the respective longitudinal edge, 72 or 74 respectively, of the removable portion.

Figure 2A:
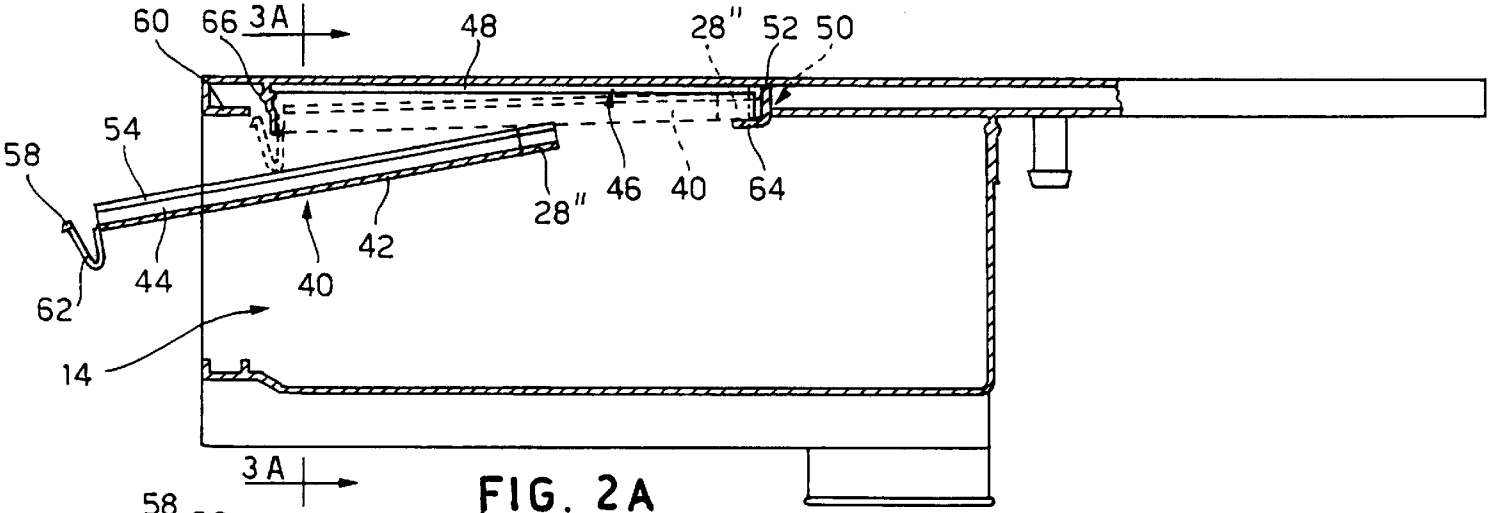
FIGS. 2A and 2B are sectioned views taken along lines 2A—2A and 2B—2B of FIGS. 3A and 3B respectively, suitable for illustrating the operations of attachment to the body of the device of the removable portion according to the first preferred embodiment of the present invention.
Figure 2B:
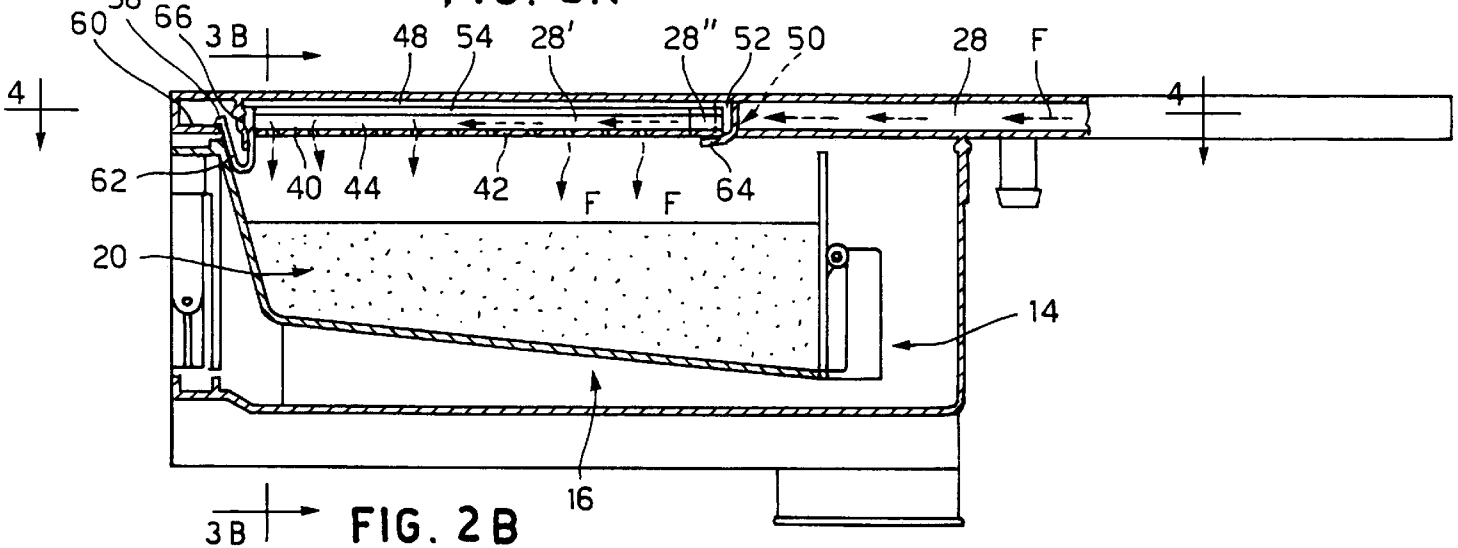

Referring particularly to FIGS. 2A and 2B, it is possible to see how the operations of engaging and disengaging of the removable portion with the body of the drawer are performed. In FIG. 2A the portion 40 is shown, by an unbroken line, in a condition of proximity to the seat for housing provided on the body of the drawer. In order to achieve engaging of said removable portion 40 with the body of the device it is necessary, as shown by the dotted lines in FIG. 2A, to insert first the nozzles of the removable portion 40 in the corresponding nozzles 52 of the body of the device, with simultaneous contact of said removable portion with the lateral and end flexible fins 64, 66, 68, 70 respectively. After which, by pressing against the tab 62, it is possible to achieve engaging of the small tooth 58 at the end of the same on the protuberance 60 of the body of the drawer, to achieve the final working position, shown in FIG. 2B.

In order to achieve disengaging in view of cleaning or replacement of the removable portion 40, it is sufficient to act in a reverse manner to the operation of assembly described above. It is in fact sufficient to push against the tab 62 to achieve disengaging of the small tooth 58 from the protuberance 60 and pull said portion 40 first downwards and then, with a slight traction action, towards the exterior of the device in order to achieve disengaging of the nozzles 24", 26", 28", 30" from the corresponding nozzles 52. As is clear, these are extremely simple operations, which can be performed easily and rapidly also by inexpert staff.

Figure 5:
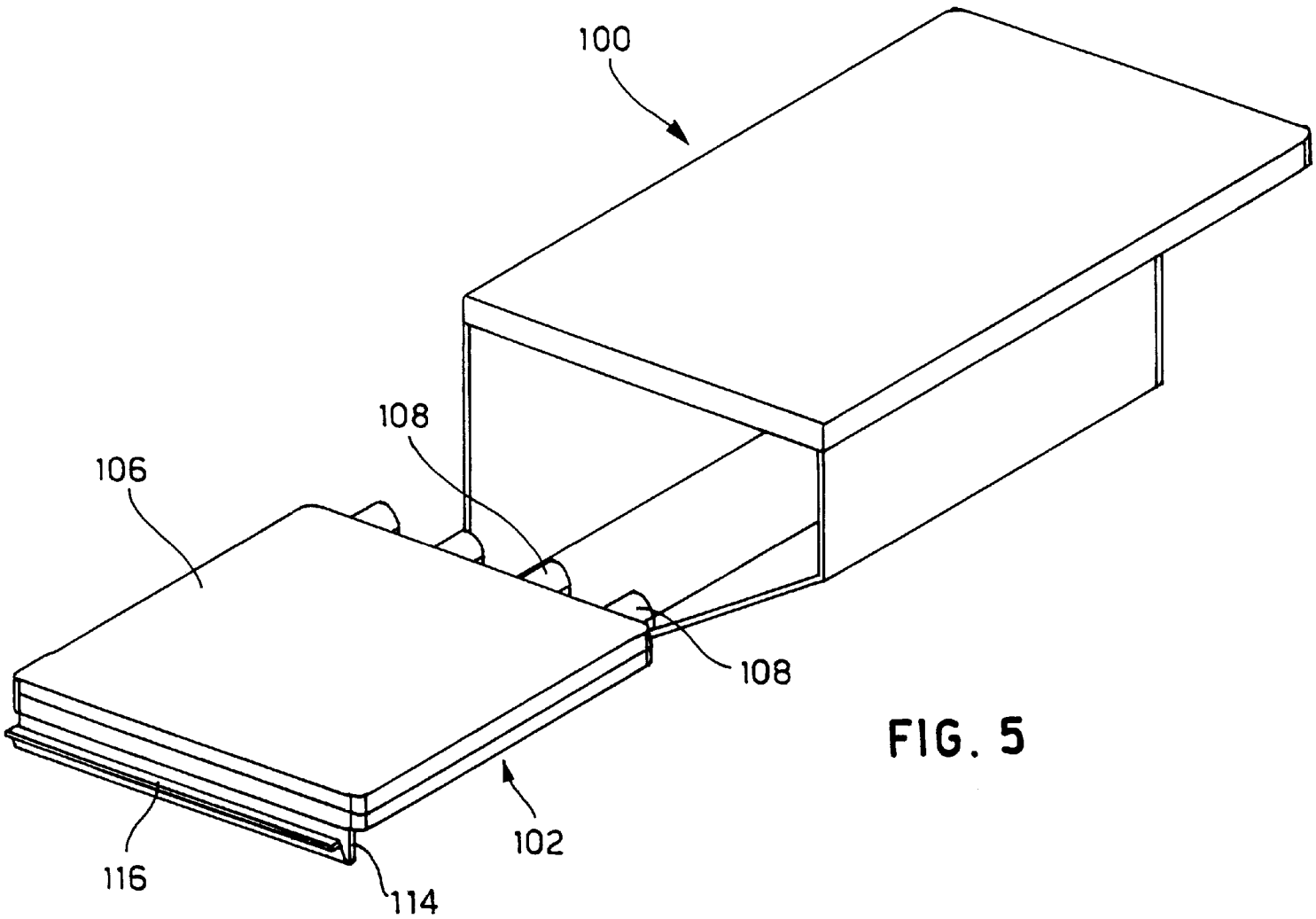
FIG. 5 is a perspective view relating to the washing agents housing device, showing the device and the removable part thereof, in accordance with a second preferred embodiment of the present invention.
Figure 6:
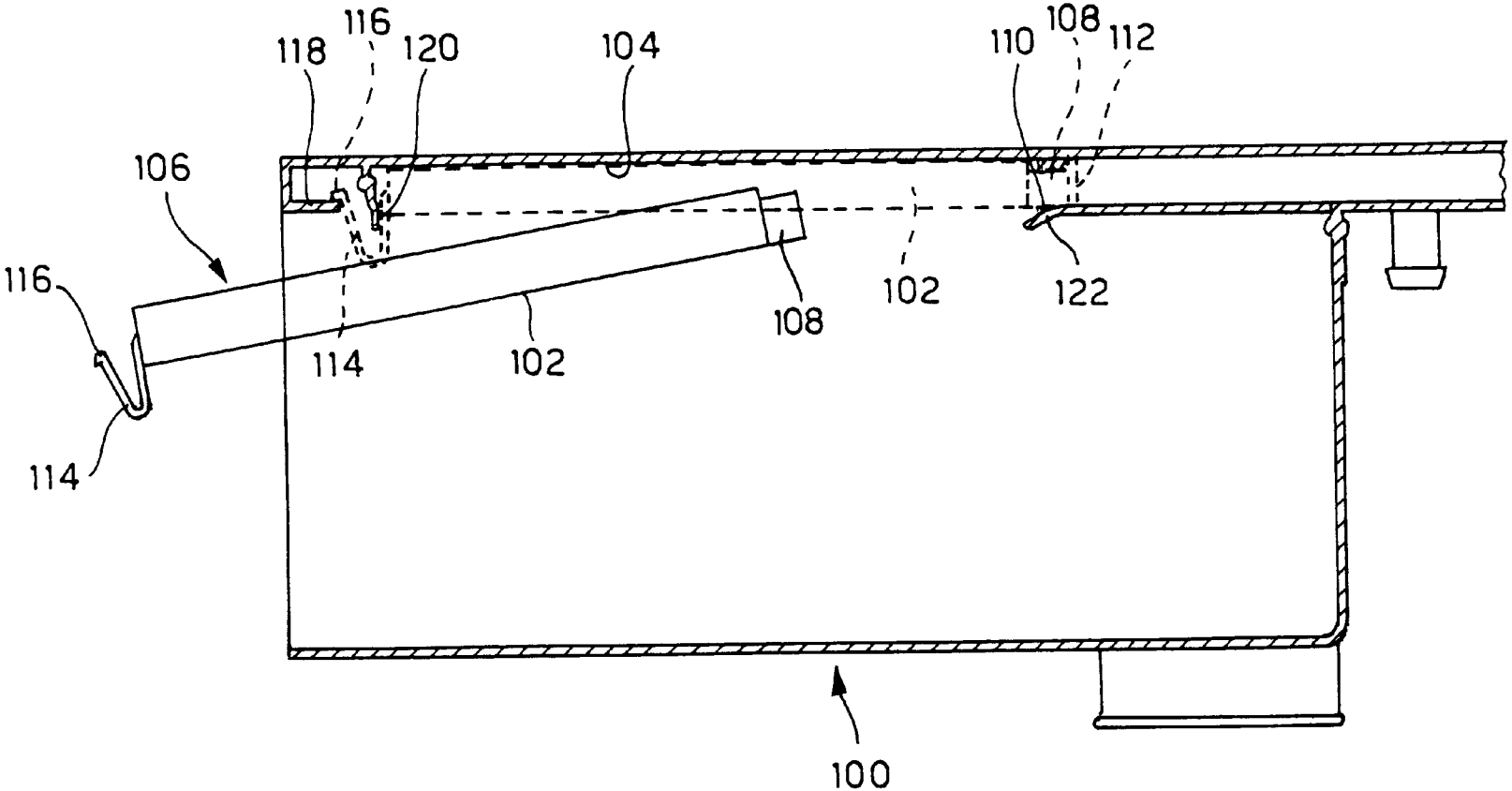
FIG. 6 is a longitudinal section view similar to that of FIG. 3A, relating to the second preferred embodiment of the present invention.

FIGS. 5 and 6 show a second preferred embodiment of the device of the present invention.

This second embodiment is in part similar to the first embodiment shown above, above all as regards the means and methods for achieving hooking of the removable portion to the body of the device. It is therefore not considered appropriate, in order not to overload the present description excessively, to describe said components and the relative operations of assembly and disassembly in detail.

We consider that it is sufficient to note that the removable portion 102 of this second version is housed in a special housing of the body of the device 100 which has, instead of the short walls for coupling 48, a flat wall 104 against which, as shown by a dotted line in FIG. 6, rests against the upper surface 106 of the removable portion 102.

In this second version end nozzles 108 are also present, similar to those of the first version described above, for feeding into the conveying conduits of the removable portion respective flows of water, which couple with corresponding nozzles 110 extending from the end vertical wall 112 of the housing.

There is also a flexible tab 114 which supports the small tooth 116 for engaging with an opposite extension 118 of the body of the device in a wholly similar manner to what has already been referred in the previous first embodiment.

There are also flexible fins which are wholly similar to the flexible fins of said first version. In the figures only the end fins 120 and 122 are shown.

The perforated portion 102 of this second embodiment is formed by a closed block having in its interior said conduits for conveying flows of water towards the holes for transfer by falling formed in the underlying part of the block and not shown expressly in the figures. For this second preferred embodiment, in the case of clogging of the conduits or holes of transfer of the block 102, the block 102 is removed from the body of the device and replaced with a new block.

Figure 7:
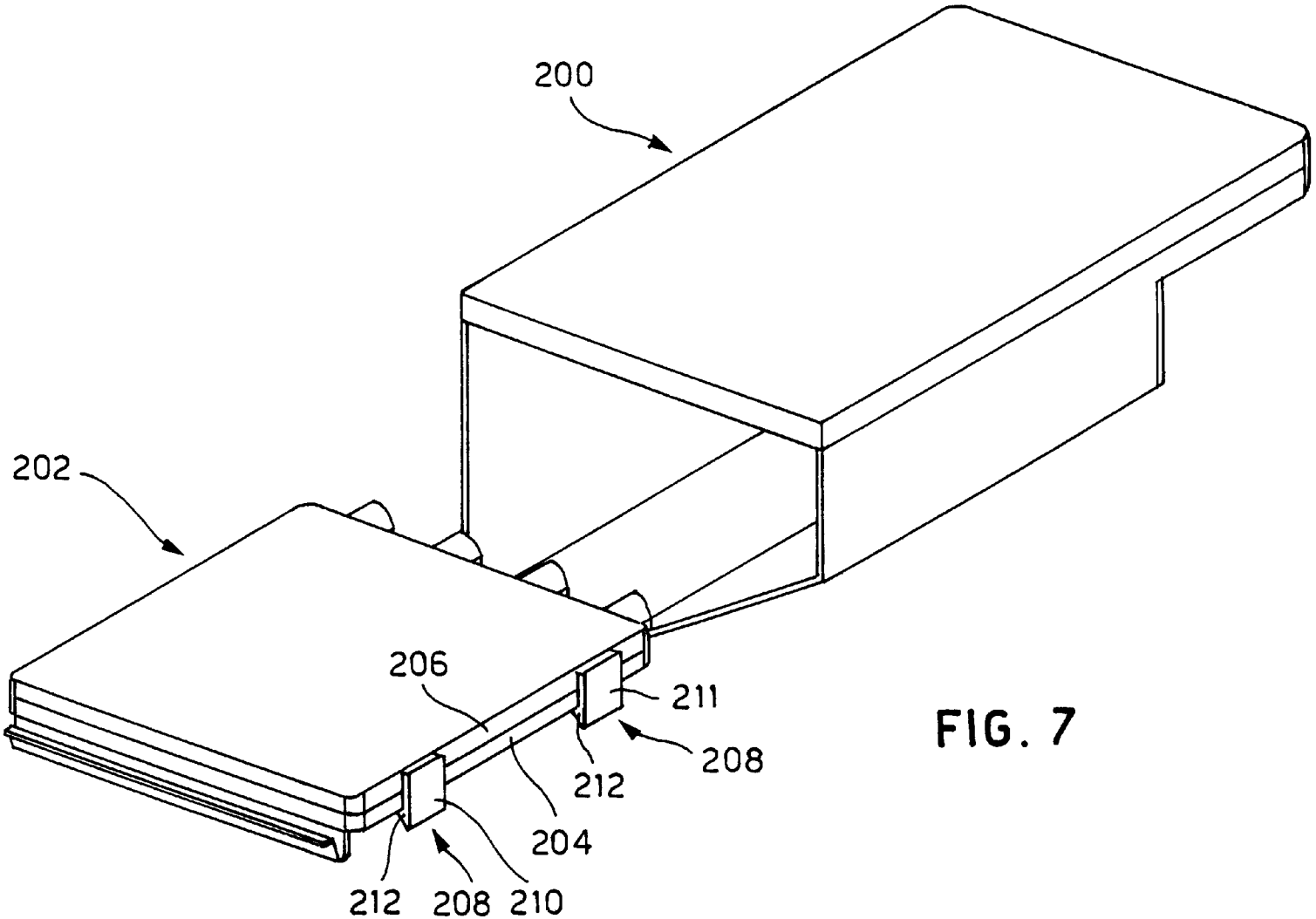
FIG. 7 is a perspective view relating to the washing agents housing device and to the removable part thereof, in accordance with a third preferred embodiment of the present invention.
Figure 8:
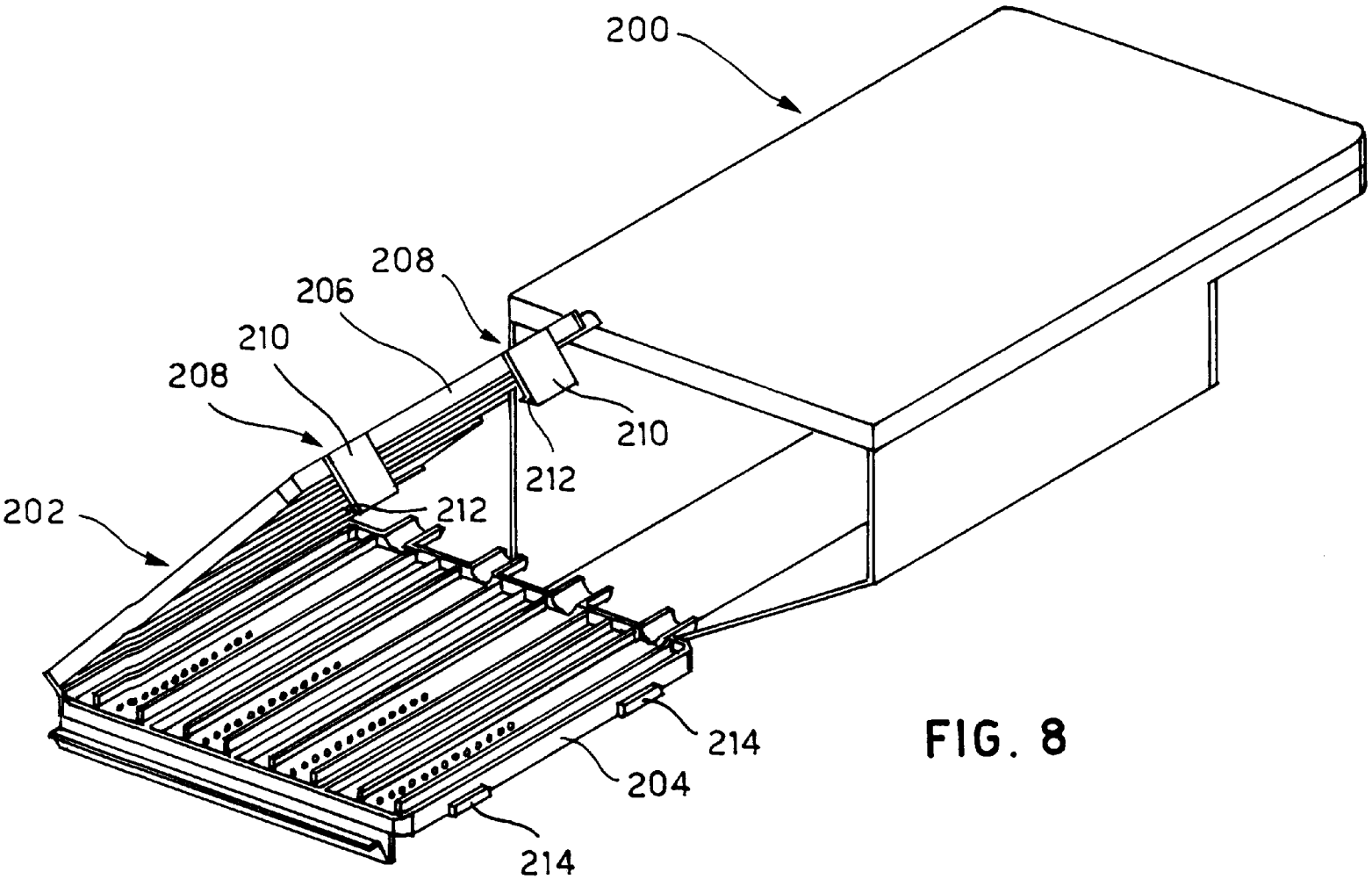
FIG. 8 is a perspective view similar to FIG. 7 showing the removable block of this third preferred embodiment in an open version.

FIGS. 7 and 8 illustrate a third preferred embodiment of the present device. This third embodiment is wholly similar to the second embodiment described previously, having a block 202 for housing conduits and underlying transfer holes which is engaged with said body 200 of the device by release means or fins wholly identical to those of the first and second embodiments shown previously.

This third preferred embodiment has additionally the fact that said block 202 is, unlike the block 102 of the second embodiment, openable to allow access and cleaning of the conduits and holes housed in said block. The block 202 comprises a lower part 204 and an upper part 206 connected one to the other by hinging along a longitudinal side and means for keeping said parts, during use, clamped reciprocally one on the other, formed by reciprocal hooking parts comprising hooks 208, composed of flexible blades 210 and end teeth 212, on said upper part 206 and projecting inserts 214 on said lower part 204, which are engaged by said teeth 212 of said hooks 208.

Figure 9:
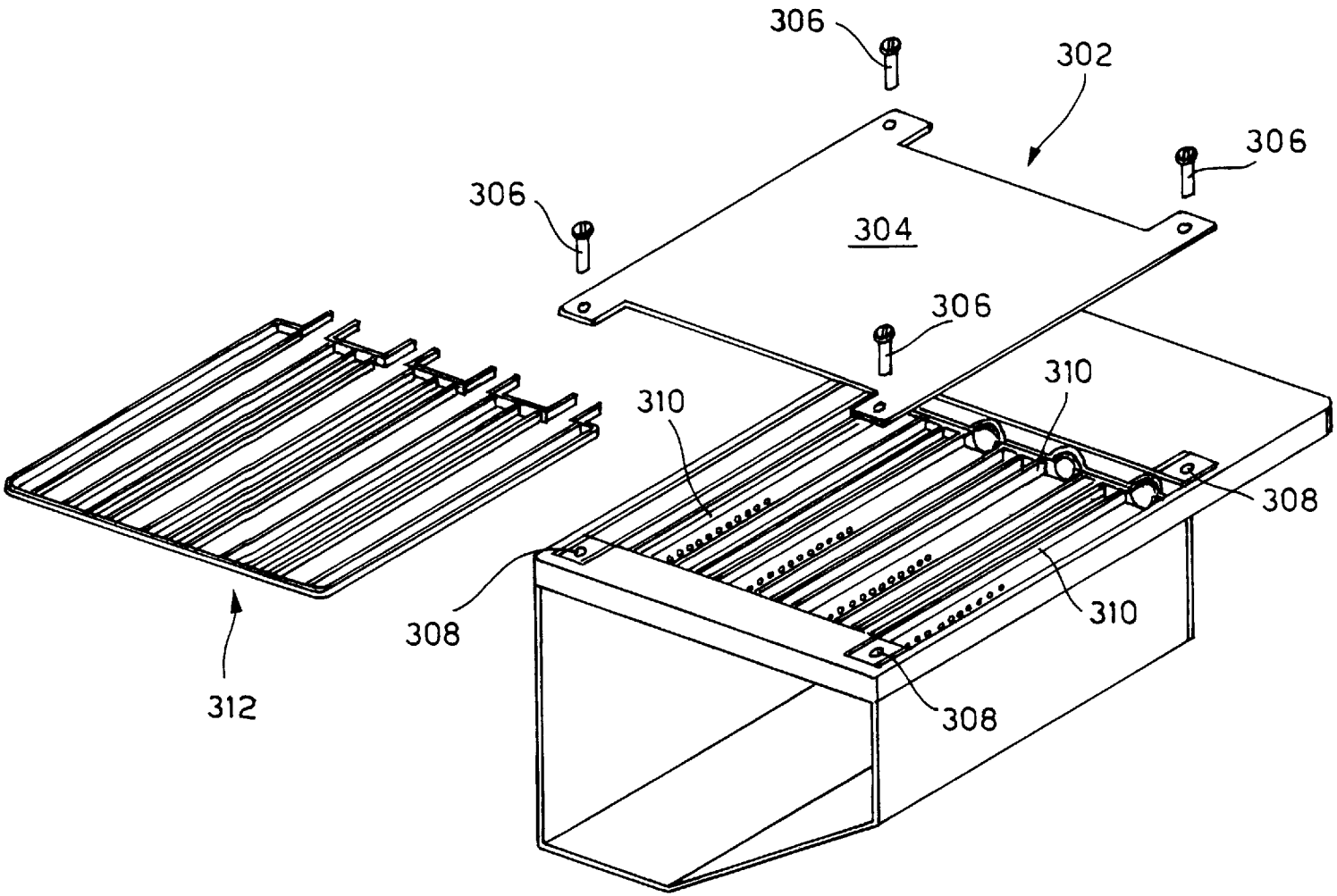
FIG. 9 is a blown-up perspective view relating to a fourth preferred embodiment of the device of the present invention.
Figure 10:
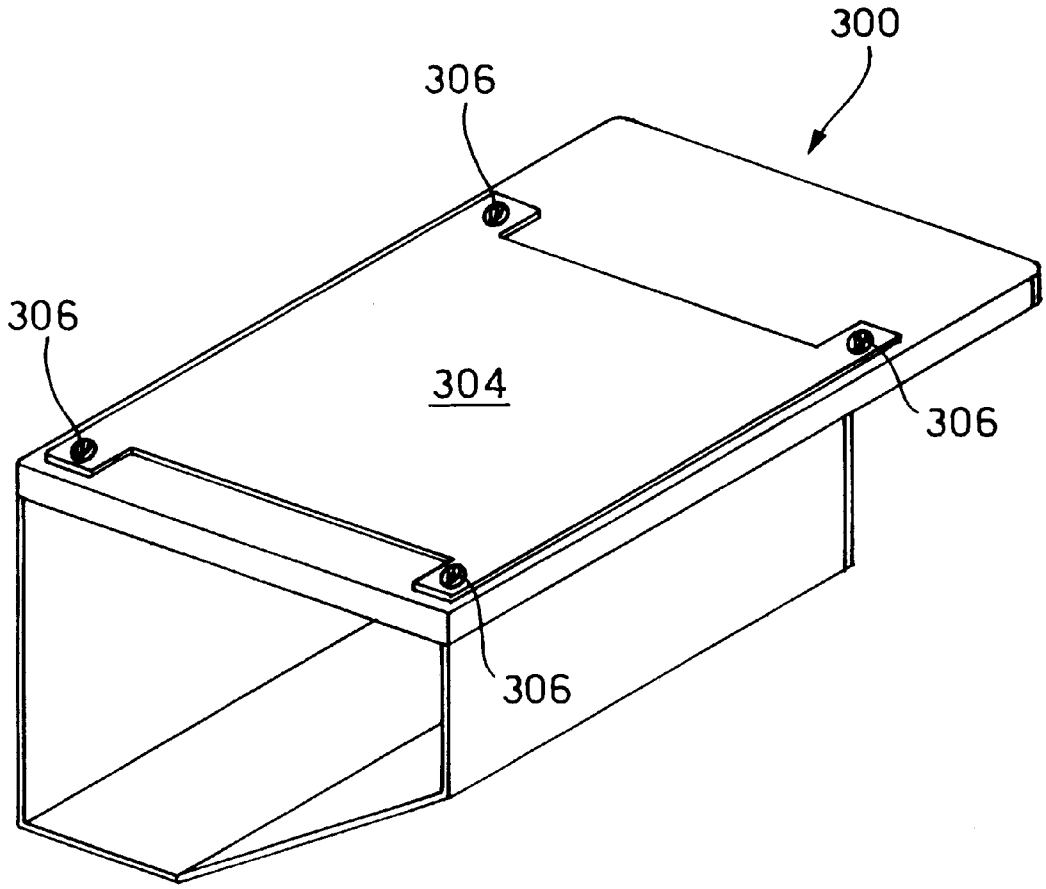
FIG. 10 is a perspective view in an assembled version of the device of the fourth preferred embodiment of the present invention.

FIGS. 9 and 10 show a fourth embodiment of the present device. This fourth embodiment differs from the previous embodiments due to the fact that here provision is made to make removable, from the body 300 of the device, a portion 302 for access to said conveying conduits and to the transfer holes with the aim of allowing cleaning thereof.

According to this fourth preferred embodiment, said portion 302 for access to said conduits for conveying flows of water comprises a covering panel 304 situated on the upper wall of the device and means for removable attachment of said covering panel consisting of attachment screws 306 which can be inserted in corresponding holes 308 provided in said body of the device.

Between the covering panel 304 and the underlying walls 310 defining the conduits for conveying the flows, means are provided for hermetic sealing formed by a gasket in an elastic material 312 shaped with linear portions which follow the profile of said walls defining the conduits.

It could also be foreseen to make said removable portion 302 for access to said conduits, in view of their cleaning or inspection, simply openable, rather than removable, merely by attaching it by hinging along one side to said body 300 of the device and providing on the other side suitable means for closure of said portion at the body of the device, for example also of the type of the same attachment screws referred above.

It must obviously be understood that what has been written and shown with reference to the preferred embodiments of the present invention has been given purely by way of a non-limiting example of the principle claimed.

What is claimed is:

1. A device for housing washing agents, comprising:

an outer body having water conduits for passing water into an interior cavity of said outer body via a conduit exit and an access opening located at one end of said outer body and sized to provide interior access to said interior cavity;

one or more washing agent mobile housing vessels adapted for removable insertion into said interior cavity and for containing the washing agents; and one or more removable conduits operatively connected to the conduit exit and having holes adapted for conveying respective flows of water towards said one or more washing agent mobile housing vessels such that the flow of water removes the washing agents from said one or more washing agent housing vessels and out of said outer body, said one or more removable conduits being arranged to be passable through said interior access, said outer body having an attachment device which engages and secures said one or more removable conduits to said outer body.

2. Device according to claim 1, wherein in a position above said interior cavity, said outer body further comprises a seat for housing said one or more removable conduits, said seat for housing having at least one upper support wall for said one or more removable conduits and at least one end vertical wall wherein nozzles are provided for coupling with corresponding nozzles of said one or more removable conduits.

3. Device according to claim 2, wherein said attachment device comprises at least one flexible fin for restraining elastically said one or more removable conduits toward and against the upper wall of the seat for housing said one or more removable conduits, said flexible fin extending substantially horizontally in such a position as to engage said one or more removable conduits at the end of coupling between nozzles of the latter.

4. Device according to claim 3, wherein said attachment device comprises at least a second flexible fin for restraining elastically said one or more removable conduits toward and against a vertical end wall of the housing for said one or more removable conduits, said flexible fin extending substantially vertically in such a position as to engage said one or more removable conduits at the end of the latter which is opposite the end coupling the nozzles.

5. Device according to claim 2, wherein said attachment device comprises at least a first and a second lateral flexible fin acting on longitudinal edges of said one or more removable conduits to clamp and push them upwards towards the upper wall of the seat which houses said one or more removable conduits.

6. Device according to claim 5, wherein said first and second lateral fins extend downwards substantially vertically and have a curved portion for engaging the respective longitudinal edge of said one or more removable conduits.

7. Device accordingly to claim 1, wherein said attachment device comprises means for releasably engaging said one or more removable conduits with said outer body.

8. Device according to claim 7, wherein said releasably engaging means comprise a hooking tooth for a corresponding protuberance of said outer body, said hooking tooth being held at one end of a flexible tab extending from said one or more removable conduits.

9. Device according to claim 1, wherein said one or more removable conduits have a substantially flat base portion and a series of short walls extending upwards and further comprising sealing means between an upper edge of said one or more removable conduits and a corresponding part of said outer body.

10. Device according to claim 1, wherein said one or more removable conduits are housed in a closed block conduits for conveying flows towards said holes for transfer provided in the lower wall of said block.

11. Device according to claim 10, wherein said closed block comprises a block composed of a lower part and an upper part connected one to the other in an openable manner and means for keeping, during use, said parts clamped reciprocally one on the other.

12. Device according to claim 11, wherein said lower part and said upper part are connected by hinging means.

* * * * *